US011072487B2

(12) United States Patent
Tien Tjiu et al.

(10) Patent No.: US 11,072,487 B2
(45) Date of Patent: Jul. 27, 2021

(54) BAGS DISPENSER AND BAGS THEREFOR

(71) Applicant: EURO PACKAGING UK LTD, Birmingham (GB)

(72) Inventors: Tan Tien Tjiu, Mt Kiara (MY); Amol Adhikrao Mohite, Shah Alam (MY); Zarak Lowe, Birmingham (GB)

(73) Assignee: EURO PACKAGING UK LTD, Birmingham (GB)

( * ) Notice: Subject to any disclaimer, the term of this patent is extended or adjusted under 35 U.S.C. 154(b) by 10 days.

(21) Appl. No.: 16/607,627

(22) PCT Filed: Apr. 24, 2018

(86) PCT No.: PCT/GB2018/051076
§ 371 (c)(1),
(2) Date: Oct. 23, 2019

(87) PCT Pub. No.: WO2018/197864
PCT Pub. Date: Nov. 1, 2018

(65) Prior Publication Data

US 2020/0122915 A1 Apr. 23, 2020

(30) Foreign Application Priority Data

Apr. 24, 2017 (GB) ..... 1706469

(51) Int. Cl.
*B65D 83/08* (2006.01)
*B65D 33/00* (2006.01)
*B65D 33/06* (2006.01)

(52) U.S. Cl.
CPC ..... *B65D 83/0894* (2013.01); *B65D 33/001* (2013.01); *B65D 33/065* (2013.01); *B65D 83/0876* (2013.01)

(58) Field of Classification Search
CPC ..... B65D 83/0894
See application file for complete search history.

(56) References Cited

U.S. PATENT DOCUMENTS 4,674,634 A 6/1987 Wilson
5,213,145 A 5/1993 Huang et al.
(Continued)

FOREIGN PATENT DOCUMENTS

EP 1147996 10/2001
GB 2337507 11/1999
(Continued)

OTHER PUBLICATIONS

Search Report issued in United Kingdom App. No. 1706469.2 (dated 2017).
(Continued)

*Primary Examiner* — Gene O Crawford
*Assistant Examiner* — Ayodeji T Ojofeitimi
(74) *Attorney, Agent, or Firm* — Barnes & Thornburg LLP

(57) ABSTRACT

A pre-formed bags dispenser comprises a container having an access aperture, a stack of pre-formed bags located in the container and having a first portion (12) deviated, preferably folded, at a transverse bend from a second portion containing mouth ends of the bags, and attachment means in the container separably attached to the mouth ends at lines of weakening, e.g. perforations. Front walls of the bags at the second portion, tensioned by the bending of the stack, are presented towards the access aperture. The bag nearest to the access aperture can be drawn out through the aperture by pulling its front wall, with one hand, relative to the attachment means. As the bag is so pulled its mouth is opened and the separable attachment to the attachment means is released. The attachment means, in one form, comprises a bar block separably joined to the mouths and/or handles of the bags. The container may be in the form of a box substantially closed apart from the access aperture, a tray or a bag.

30 Claims, 21 Drawing Sheets

(56) References Cited

U.S. PATENT DOCUMENTS

| | | | | |
|---|---|---|---|---|
| 5,464,098 | A | 11/1995 | Tseng et al. | |
| 6,655,546 | B1 * | 12/2003 | Bolton | B65D 33/001 206/554 |
| 8,534,462 | B1 | 9/2013 | Tan | |
| 2003/0136793 | A1 | 7/2003 | Chen | |
| 2007/0080091 | A1 * | 4/2007 | Dickinson | B65D 33/001 206/554 |

FOREIGN PATENT DOCUMENTS

| | | |
|---|---|---|
| WO | WO 99/30985 | 6/1999 |
| WO | WO 2013/006161 | 1/2013 |

OTHER PUBLICATIONS

Search Report and Written Opinion issued in Int'l App. No. PCT/GB2018/051076 (dated 2018).

* cited by examiner

BAGS DISPENSER AND BAGS THEREFOR

This invention relates to a bags dispenser and stack of bags therefor, the dispenser being of the kind in which a stack of pre-formed bags is located to be dispensed therefrom.

Dispensers of the kind referred to and the pre-formed bags are commonly used, for example, in stores, supermarkets and other outlets for goods for the bags to be used for packaging of the goods. They may also be used in other places for the bags to be used for packaging and storing articles of various kinds.

One such dispenser is known from WO99/30985. This dispenser uses friction and electrostatic adhesion between bags in a folded stack retained in a container to facilitate dispensing of bags, open, to the user upon removal from the container. The dispenser in WO99/30985 requires the user to remove the bag from the stack with a pinching and pulling action. Such an action is not always clear to a user.

There is a need for the bags to be readily removable from the dispensers and opened for filling. The present invention is aimed at meeting that need.

According to a first aspect, there is provided a bag dispenser comprising a container and located therein a stack of pre-formed bags and attachment means, the container having an access aperture; the bags of the stack each having a body which is formed with opposed front and back walls forming closed sides, a closed base end and an opposite mouth end; the bags being retained together in the stack by separable attachment at their mouth ends to the attachment means at lines of weakening; each bag having an adhesion portion formed on the front and/or back wall thereof adjacent the mouth end and adjacent one side, the adhesion portions of alternate bags in the stack being formed adjacent respectively opposite sides relative to the next bag in the stack so as to adhere the back wall of one bag to the front wall of the next bag in the region of the adhesion portion, the stack having a transverse bend intermediate the base and mouth ends of the bags whereby at least part of the front walls of the bags are presented towards the access aperture to enable the bag nearest the aperture to be drawn out through the aperture by manual pulling, whereby the friction between the container and the stack of bags and the relative strengths of the lines of weakening and the adhesion portions, upon removal of the uppermost bag in the stack, cause the uppermost bag to be pulled from the container and cause the next bag in the stack partially to be pulled from the container, the adhesion portion between the uppermost bag and the next bag being arranged to fail after part of the next bag has been pulled from the container.

By arranging the adhesion portions adjacent alternate, upper sides of the bags in a stack, each bag is pulled out of the container diagonally so that one upper corner of the next bag in the stack is pulled forth from the container to protrude slightly therefrom upon removal of the uppermost bag.

This protruding part of the next bag has several advantages over prior bag dispensers. Firstly, the protruding part is an obvious signal to the user as to what to pull in order to remove the bag from the stack. Secondly, the diagonal pulling action to which the next bag in the stack has been subjected upon removal of the uppermost bag helps to present the next bag open to the user on its subsequent removal.

Whilst the fully folded form of the stack is preferred, the first portion of the stack containing the base ends of the bags may be deviated to a lesser extent about the transverse bend away from the second portion of the stack containing the remainder of the bag bodies. This can still afford useful resistance to movement of the parts of the bags which assists in the opening of the mouths of the bags as they are drawn out through the access aperture, and inhibits separation of more than one bag at a time from the stack.

The bags may be formed with or without handles at their mouth ends. If they have handles, the handles may be separably attached to the attachment means. The separable attachment of the bags to the attachment means may then be at the handles alone or at the handles and mouths of the bags. Moreover, the adhesion portions are then preferably formed on alternate handles.

The attachment means may comprise a bar block of the material of the bags separably attached to the mouth ends of the bodies of the bags. If the bags have handles, the bar block may be separably attached to the mouths of the bodies and/or to the handles. When attached to the mouth ends and handles the bar block may be a T-bar block, the cross part of the T extending between, and being joined to, the handles, and the stem part of the T being joined to the mouths intermediate the handles.

Alternatively the attachment means may comprise projections on, and integral with, the mouth ends of the bags. The projections may be at the mouths and/or the handles of the bags.

Yet a further possibility is for the attachment means to comprise a combination of a bar block and projections at the mouth ends of the bags.

In an embodiment in which the bags each have parallel handles integral with the body extending from opposite extremities of the mouth end, the attachment means may comprise a T-bar block, the handles and mouth of the body of each bag being separably joined to the T-bar block, the handles at opposite ends of a cross bar part and the mouth at an intermediate region to a stem part, and the closed base end of the bag having separably joined thereto a tab which is located with respect to the stem part of the T-bar block when the stack is folded at the bend.

The tabs of the bags may be located with respect to the stem part of the T-bar block in various ways. For example, the tabs may be adhesively bonded, hot pin attached or welded to the stem part, or may be attached to a pin or other retainer, or by string, at the stem part.

The T-bar block serves to hold the bags securely at their handles and mouth ends and restrain the bodies of the bags from sagging at the mouths. Location of the base ends of the bags at the stem part of the T-bar block by the tabs restrains the base ends from unintentional movement. This enables a stack to be retained in a neat state in the container of the dispenser.

Preferably the tabs are separably joined to the base ends of the bags by lines of weakening.

The lines of weakening providing the separable attachment of the bags to the attachment means, and at the tabs, may be formed conveniently by lines of perforations.

Whether the bags have or do not have handles, the sliding movement described earlier of the front wall of a drawn bag with respect to the back wall of the bag creates a peeling effect in opening the mouth of the bag. This effect is accentuated by the diagonal pulling action created by the alternating adhesion portions. By this effect, the part of the mouth nearest to where the front wall of the bag is pulled opens initially and the opening action spreads along the mouth away from that part. As the mouth opens the front wall is drawn away from the back wall, which maintains contact with the front wall of the next bag in the stack until the final stages of separation of the drawn bag from the attachment means.

The access aperture of the container may restrict access to the front wall of the bag nearest to the aperture to an area of the front wall near to the mouth of the bag. However, it is generally more convenient, for ease of access to, and drawing out of, the bag, for the access aperture to extend from adjacent to the mouth of the nearest bag to the bend in the stack. Thus the bag may be pulled at any part of the front wall between the mouth and the bend, or even at the bend. In this case the access aperture may be enlarged at or towards the bend.

The access aperture may leave the attachment means unexposed, or substantially so, in the container. Thus the access aperture may end at or near the mouths of the bags of the stack. When the bags of the stack have handles at their mouth ends, the access aperture may have an edge, which may be rigid, or at which a restraint is provided, positioned to deter a person from putting his or her hand into the container between the handles.

An indicator may be provided on the container at or adjacent to the access aperture to indicate to a user where access is to be gained to the stack for drawing a bag from the stack.

The container may be of a generally box or tray-like form having a front part in which is the access aperture. In a box form, the container may be defined as a cartridge which is substantially closed except for the access aperture. In a tray-like form, the periphery of the aperture may be defined by a marginal portion around the open side of the tray. Alternatively, the container may be a bag or a shrink wrapped plastics material.

The container may be made to be disposed of when once the stack has been fully dispensed from it, or it may be made to be re-usable, being filled with another stack of bags when the original stack has been dispensed. It may be made of any suitable material, for example cardboard, plastics or metal, or a combination of materials. At least when made of cardboard, the container may be formed from a single integral sheet cut and having fold lines defined in it for the container to be folded into its finished shape.

In one embodiment of the dispenser the container is of a generally box-like form having opposite ends and sides and opposed front and back walls in the front one of which the access aperture is provided. The stack of bags located in the container has the attachment means held captive in the container at or adjacent to one of the opposite ends. The attachment means may comprise a bar block or a lug or lugs separably attached to the bags in the stack. In the lug or lugs form, the or each lug at each bag may be separable, as the bag is drawn out through the access aperture, from a further component of the attachment means held captive in the container.

The stack may be folded on a support inside the container. The support may be of a plate, or generally plate-like, form in which there is an opening. The stack may be held captive to the support, within the container, at one end part of the support and extend from that end part along the support to the opening where it is then passed through the opening and folded back along the support, so that the bend of the stack is in the opening. Preferably the support is removable from the container for the stack to be loaded onto it, and, if desired, for replacement stacks to be located onto the support as a stack is fully dispensed from the container. The support may be slidable into and out of the container. It may have a handle for ease of maneuvering it relative to the container. When the stack is loaded onto the support outside the container it may be retained to the support at the attachment means, be laid along one surface of the support and fed through the opening in the support. As the support is subsequently inserted into the container the part of the stack that has been fed through the opening is caused to be folded back against an opposite surface of the support to form the first portion of the stack.

Instead of a generally box or tray-like form, as mentioned, the container may be a bag, for example of plastics sheet material, which has the access aperture in a frontal part.

Retention means may be provided at the container which is engaged with the attachment means and anchored to the container to hold the attachment means captive in the container. For example, in the generally box or tray form of the container, and when the attachment means comprises a bar block, the retention means may comprise a header part of the container which is folded around the bar block, or a part thereof, to hold the bar block captive in the container. An integral portion of the material of which the box or tray is made may define the header part. In another form the retention means may comprise a pin or pins passed through the attachment means and anchored to a wall or walls of the container. A pin may also engage in holes in the tabs which may be provided at the base ends of the bags to locate the tabs with respect to the stem part of the T-bar block example of attachment means referred to above.

In yet another form the retention means may comprise an anchorage element, for example a block, fixed in the container and the stack may have a hole, in or adjacent to the attachment means, in which the anchorage is engaged. Other suitable forms of retention means may be provided.

The container may be mounted on a bracket or other mounting at a point of use. It may be removably and replaceably mounted on the mounting. It may be supported by the mounting in a horizontal, vertical or inclined attitude, as may be convenient for user access to the stack of bags in the container at the access aperture. The dispenser may be used without having the container mounted on a mounting. The point of use may, for example, be a check-out counter in a store or a work station.

According to a second aspect the present invention consists in a stack of bags adapted to be used in a dispenser in accordance with the first aspect of the invention herein set forth.

According to a third aspect of the invention, there is provided a stack of pre-formed bags, each bag comprising a body having a front wall and a back wall defining opposite closed sides, a closed base end and an open mouth end, each bag having an adhesion portion formed on the front and/or back wall thereof adjacent the mouth end and adjacent one side, the adhesion portions of alternate bags in the stack being formed adjacent respectively opposite sides relative to the next bag in the stack so as to adhere the back wall of one bag to the front wall of the next bag in the region of the adhesion portion.

Embodiments of the invention will now be described, by way of example only, with reference to the accompanying drawings, in which.

Figure 6A:
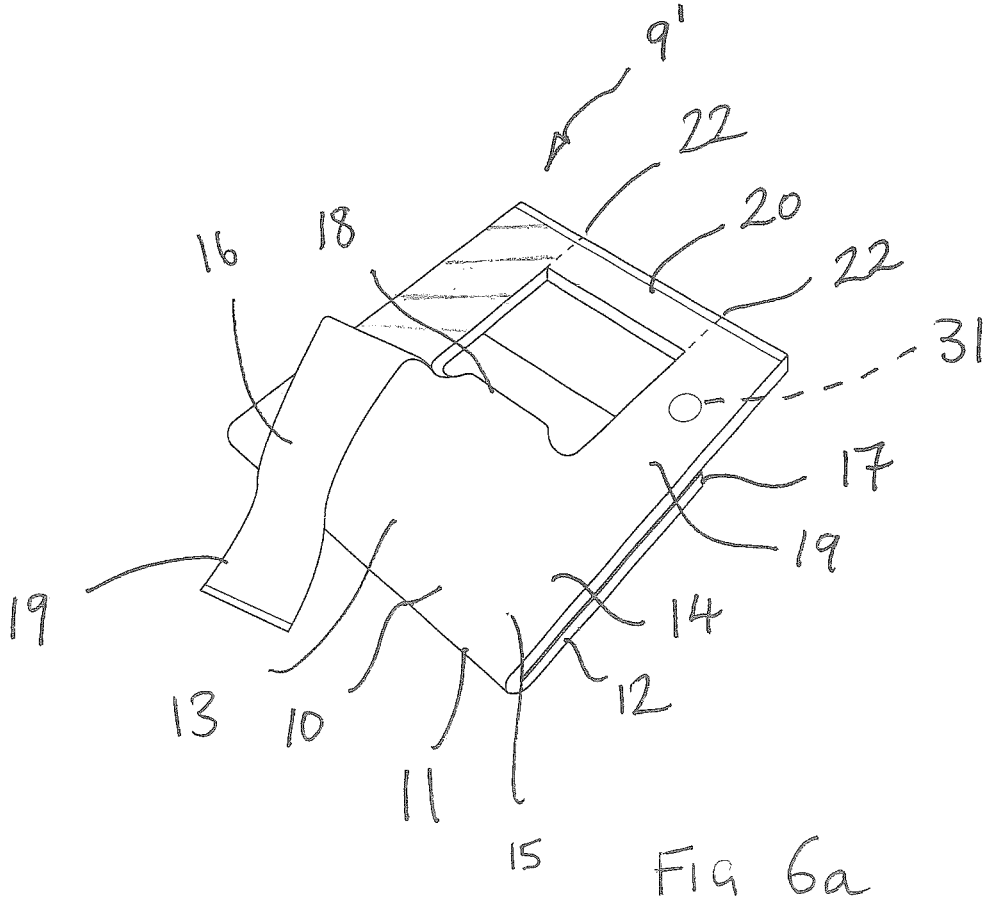
Figure 6B:
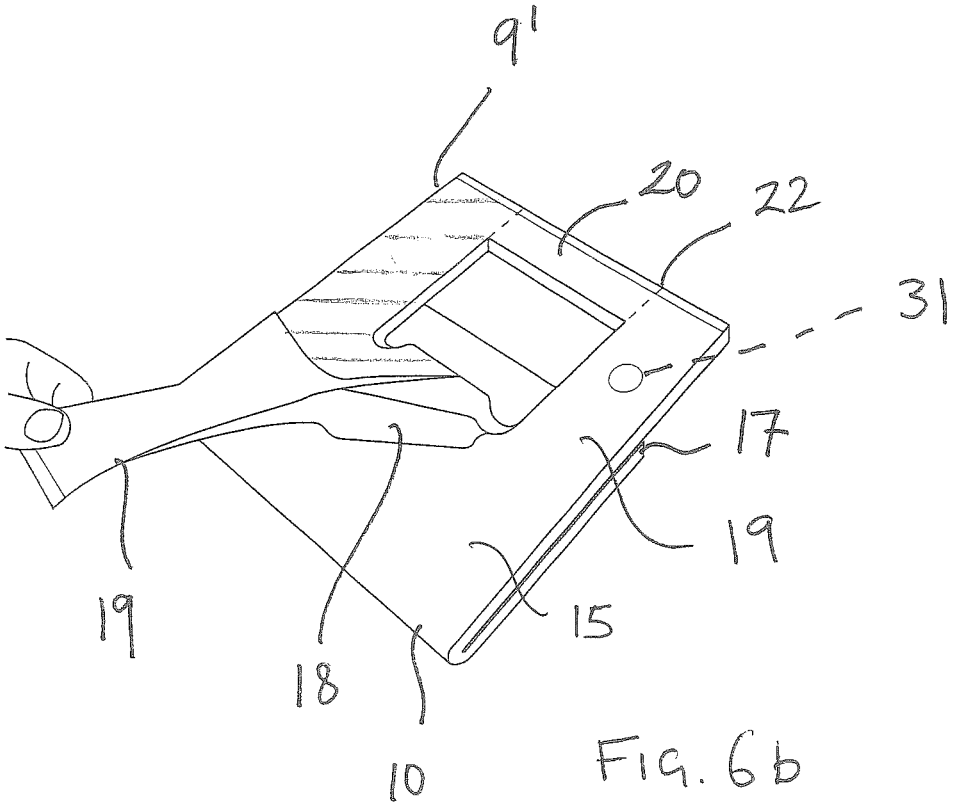
Figure 6C:
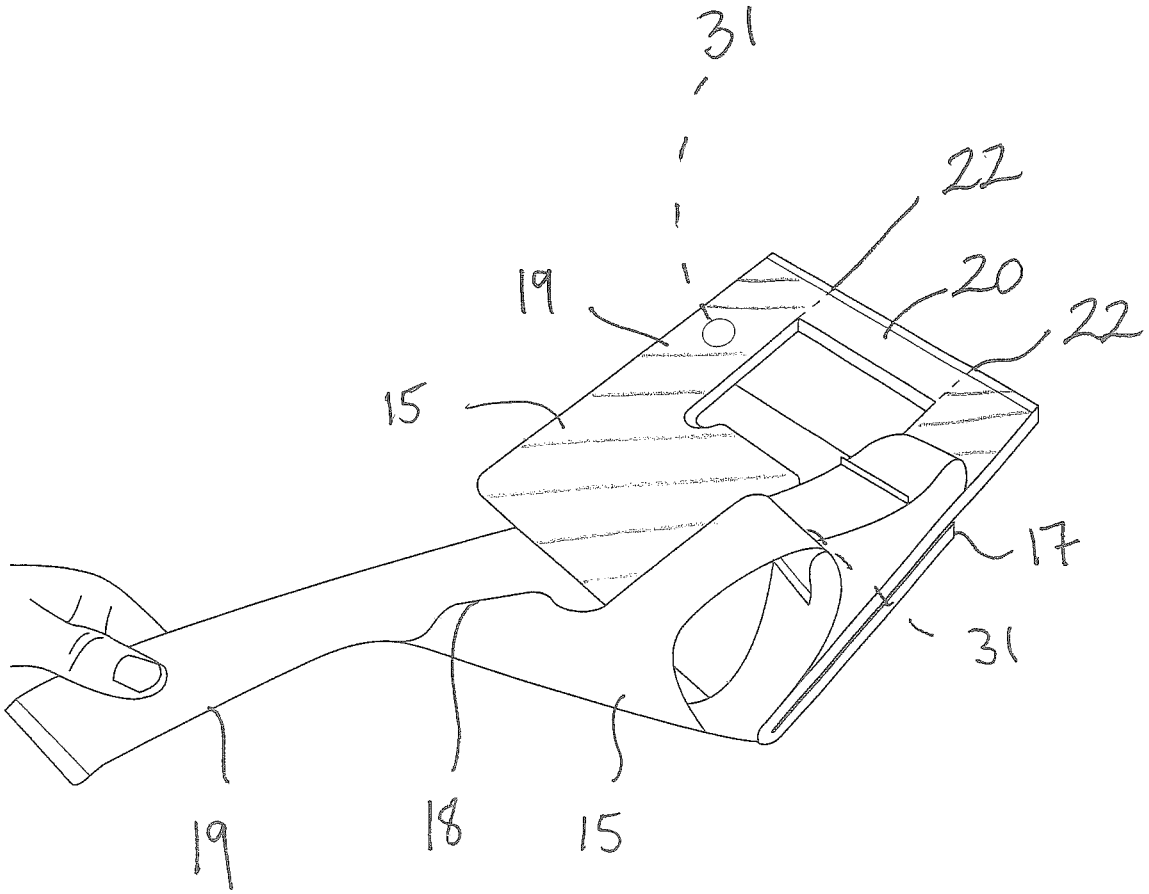
Figure 6D:
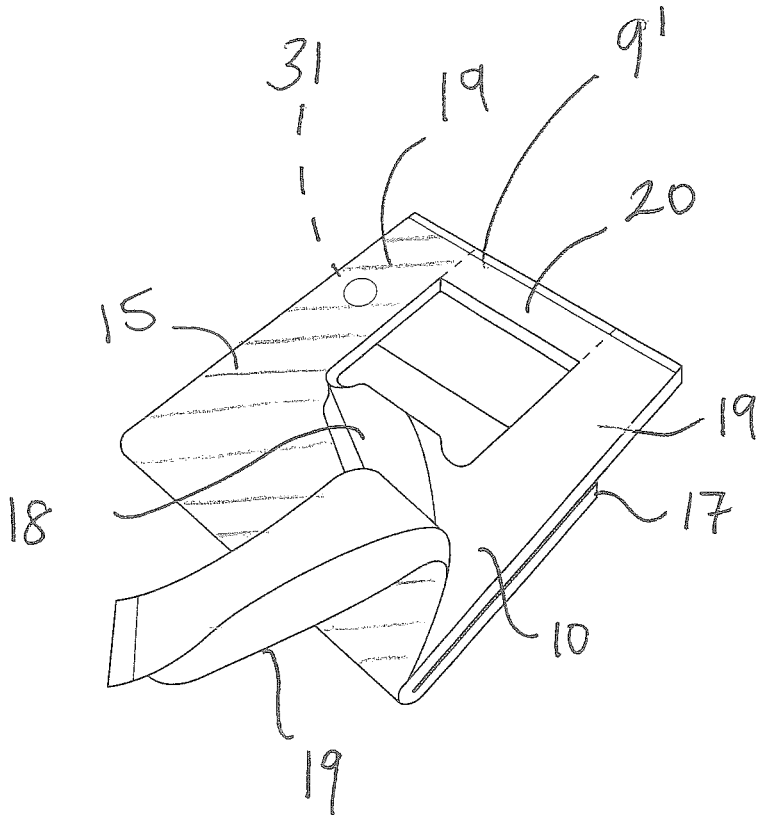
Figure 7A:
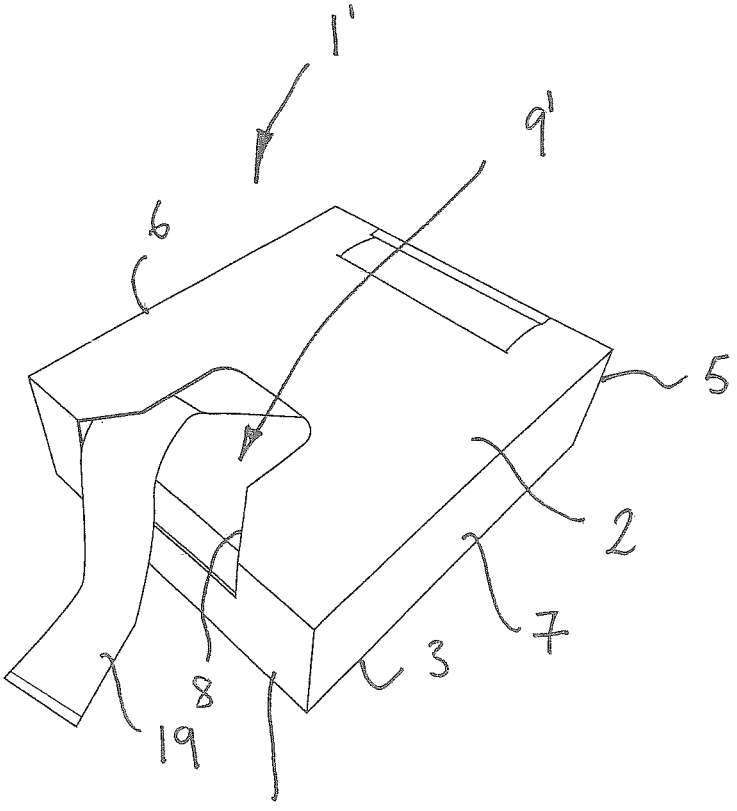
Figure 7B:
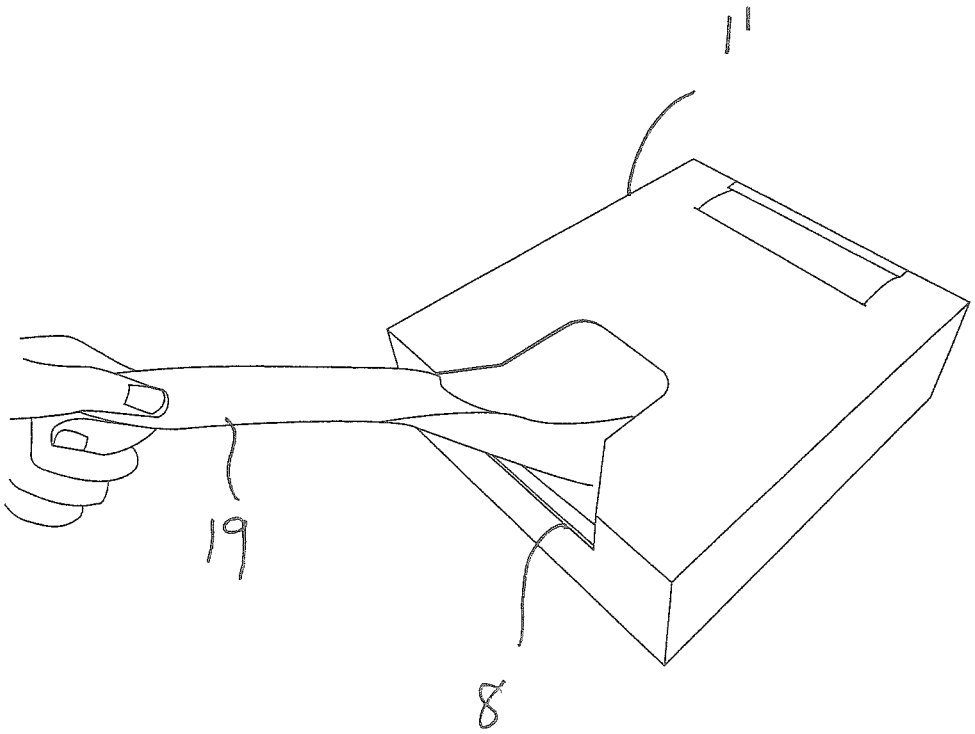
Figure 7C:
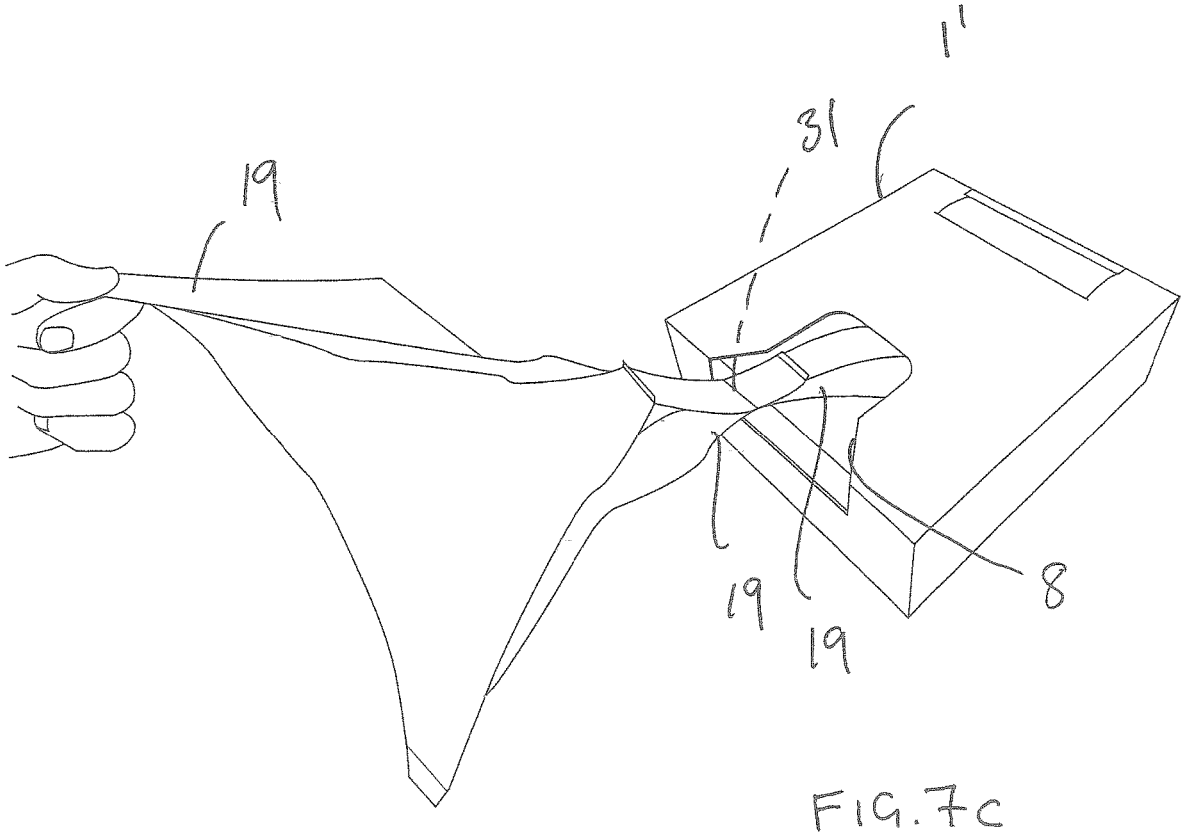
Figure 7D:
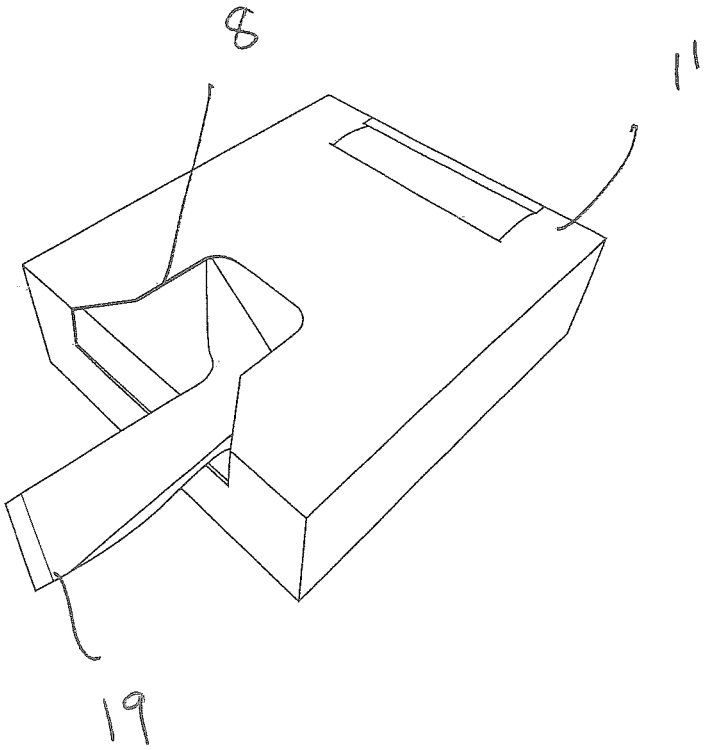
Figure 8:
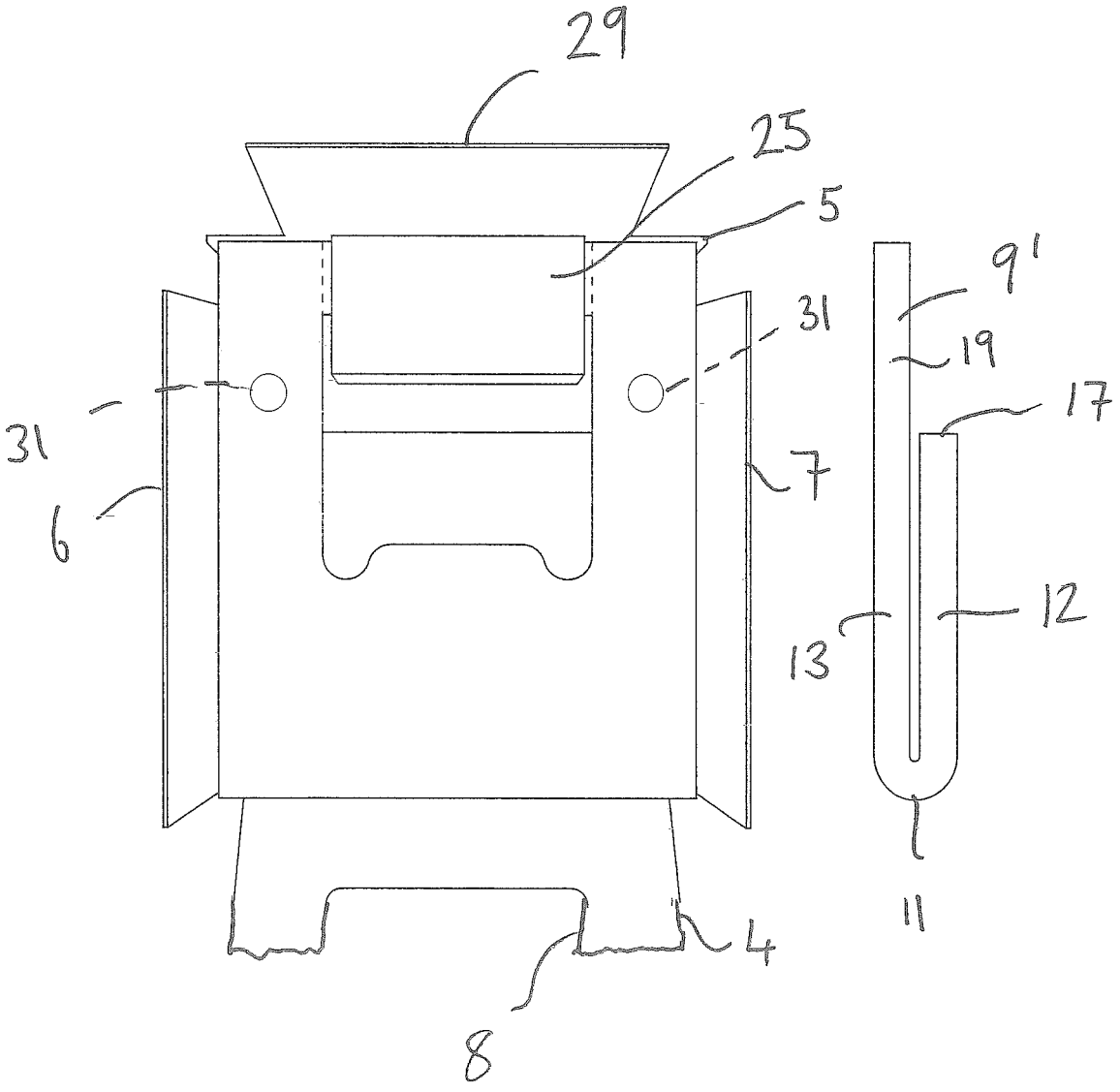

FIGS. 6*a* to 6*d* are perspective views showing a stack of bags in accordance with the second and third aspects of the invention;

FIGS. 7*a* to 7*d* are perspective views showing a dispenser in accordance with the first aspect of the invention;

FIG. 8 is a front elevation of the dispenser of FIGS. 7*a* to 7*d* showing the dispenser opened up and showing, separately, a side elevation of the stack of bags of FIGS. 6*a* to 6*d;*

Figure 9A:
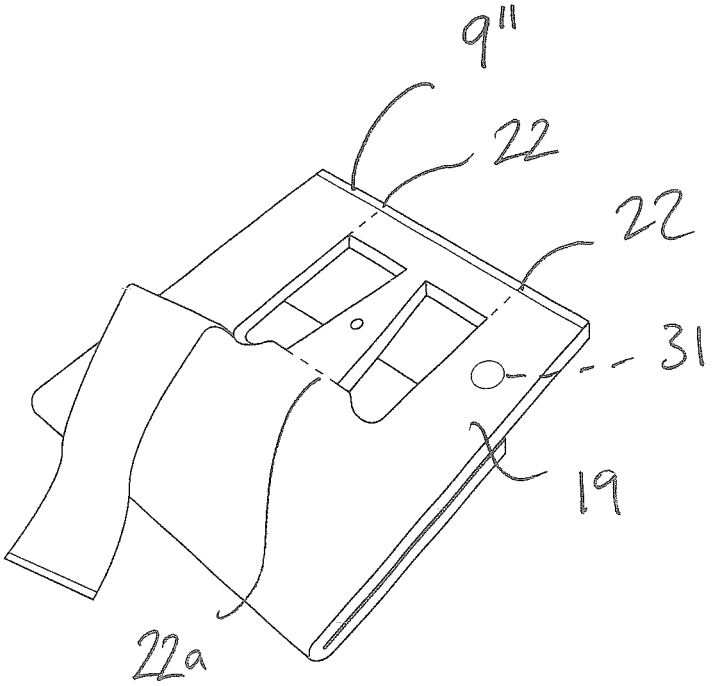
Figure 9B:
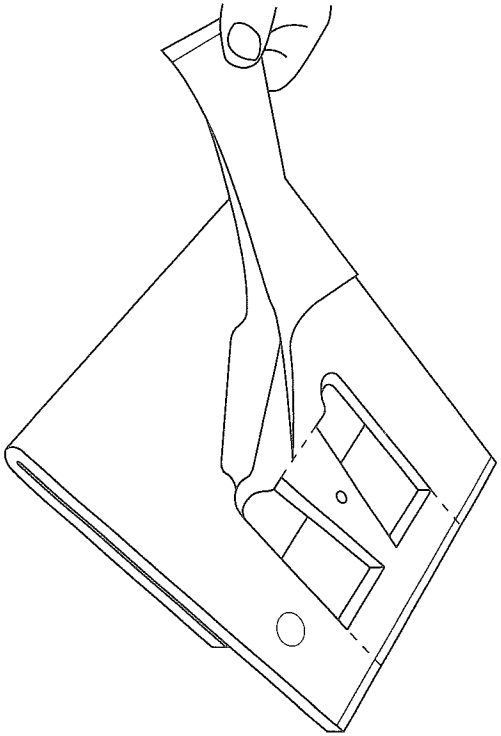
Figure 9C:
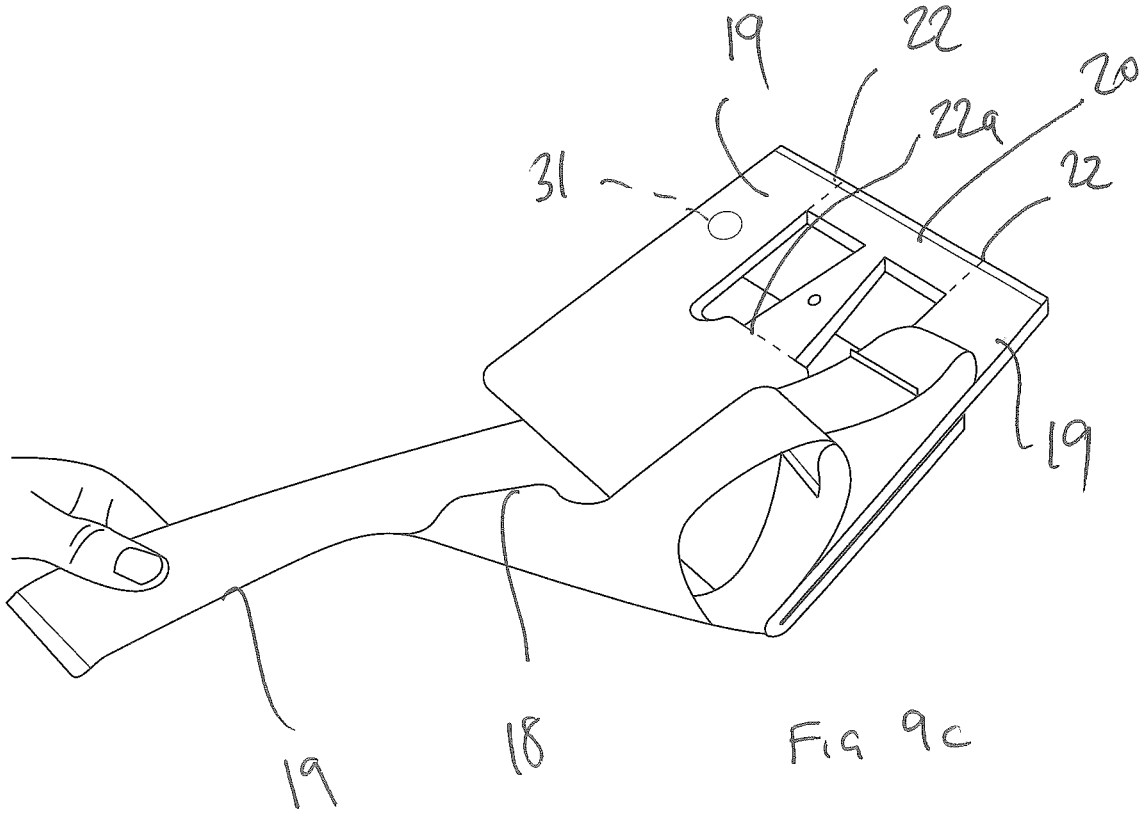
Figure 9D:
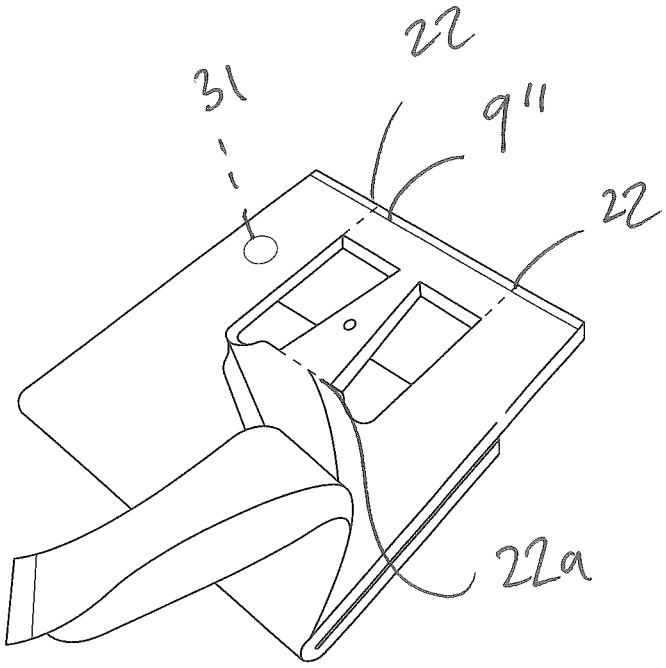
Figure 10:
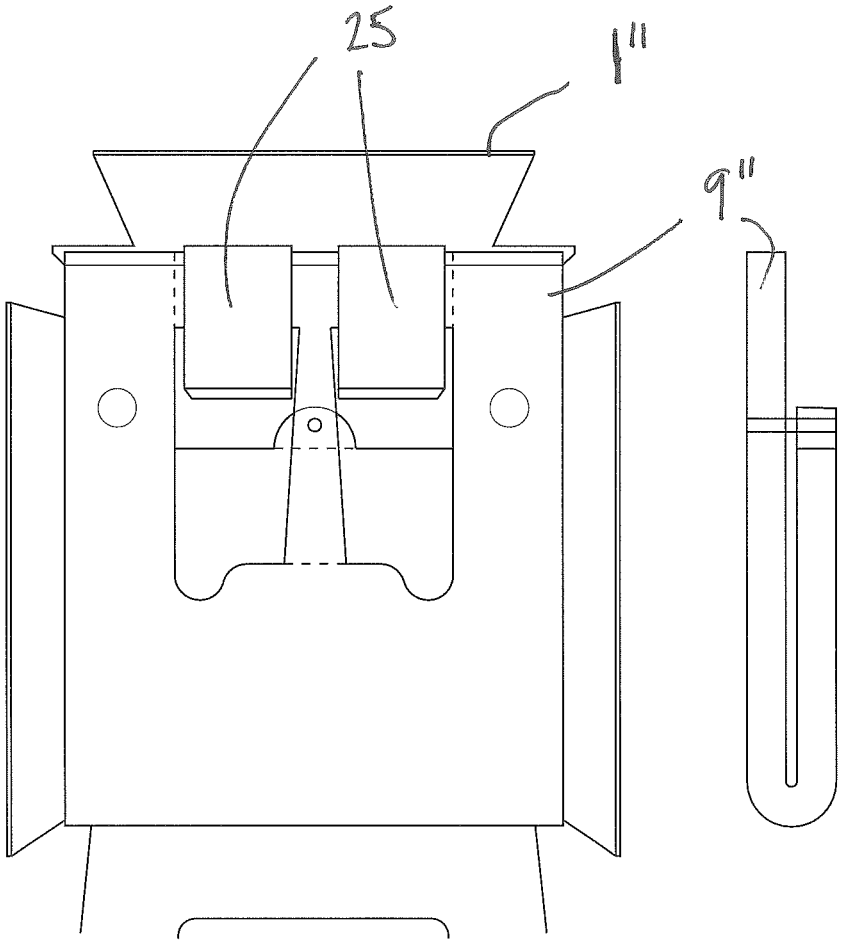
Figure 11:
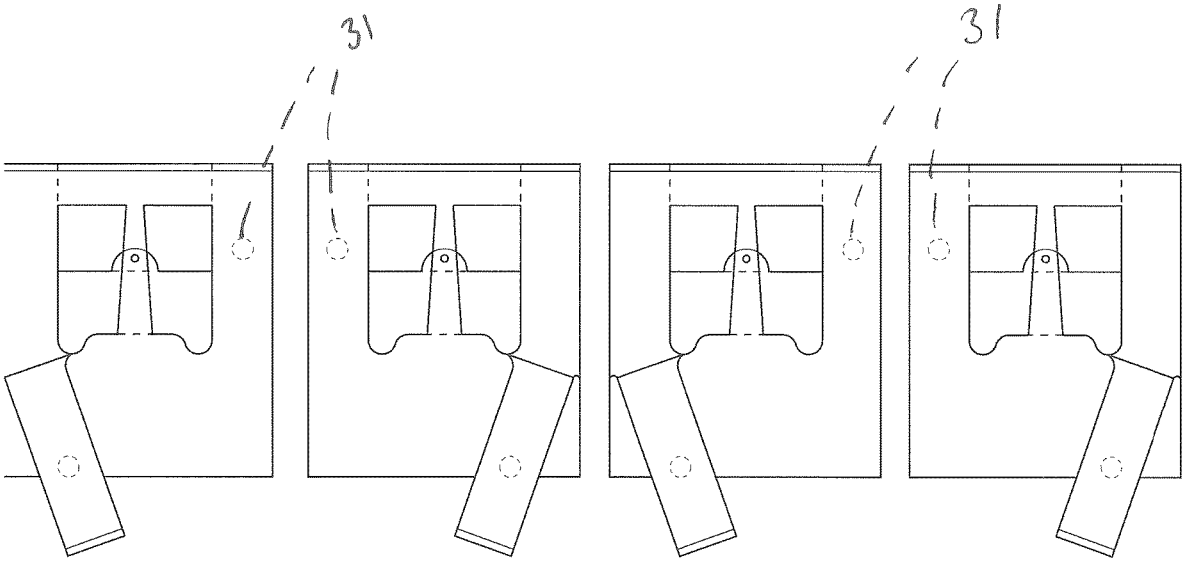
Figure 12A:
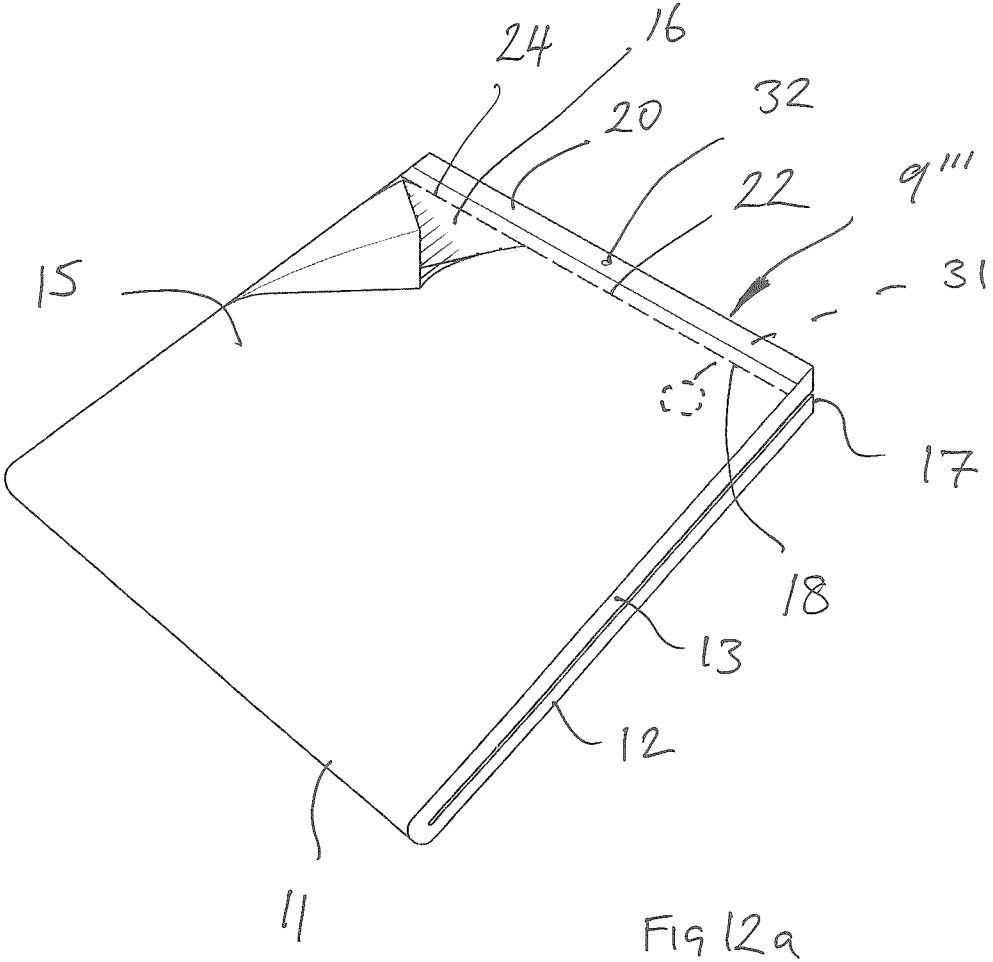
Figure 12B:
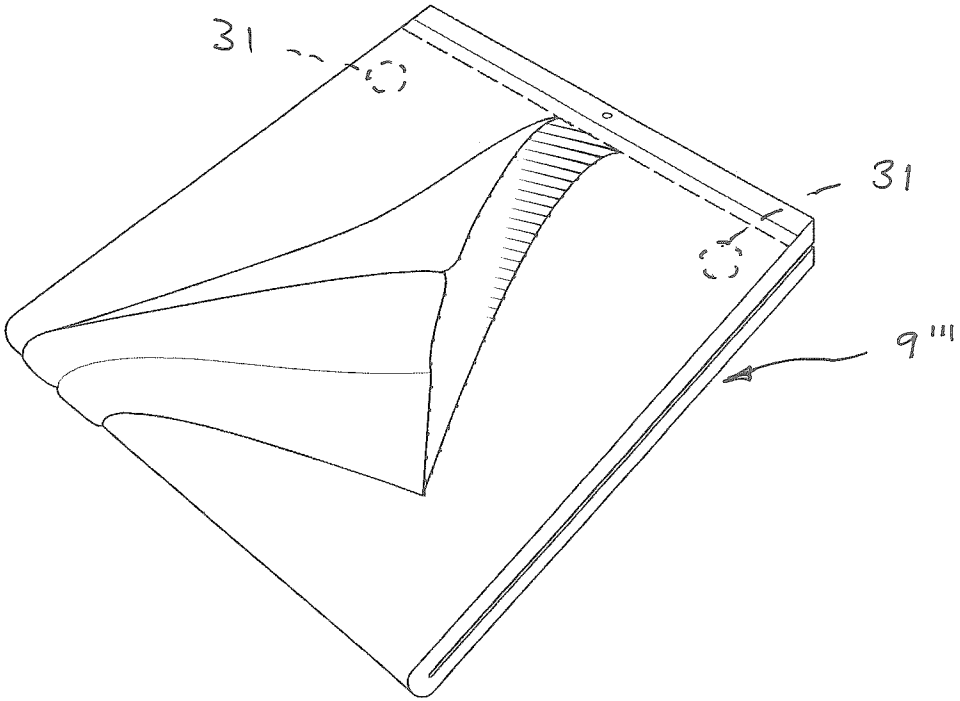
Figure 12C:
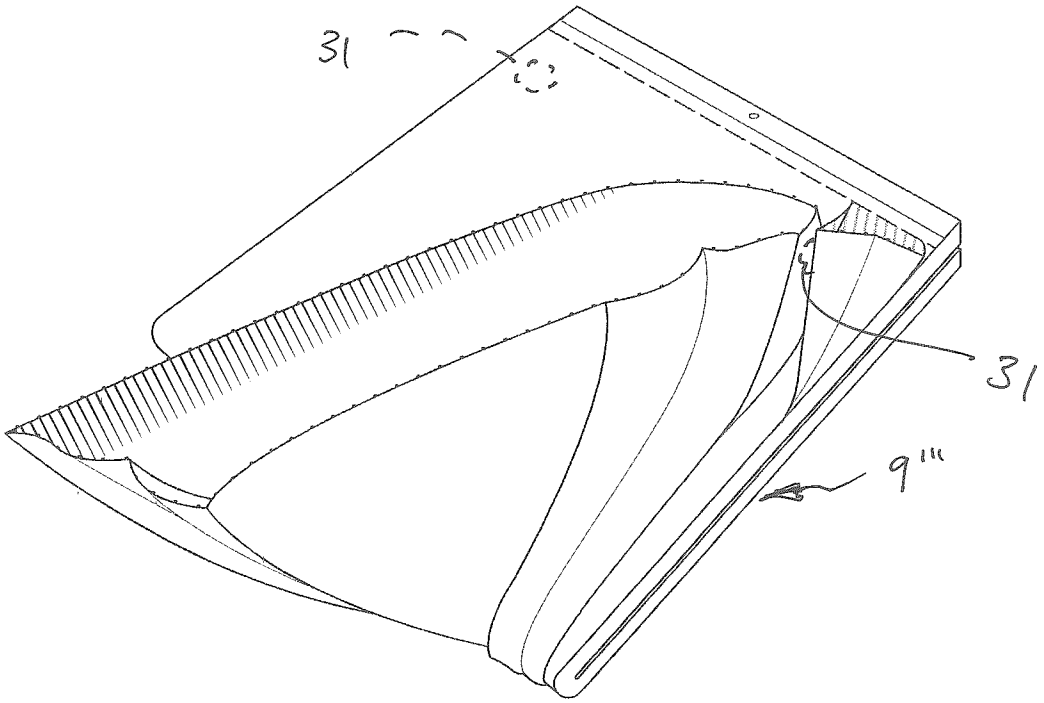

FIGS. 9*a* to 9*d* are perspective views of an alternative stack of bags in accordance with the second and third aspects of the invention;

FIG. 10 is a front elevation of an alternative dispenser in accordance with the first aspect of the invention receiving the stack of bags of FIGS. 9*a* to 9*d* and showing, separately, the stack in side elevation;

FIG. 11 is a front elevation of the stack of FIGS. 9*a* to 8*d* showing the alternating arrangement of adhesion portions; and FIGS. 12*a* to 12*c* are perspective views of a further alternative stack of bags in accordance with the second and third aspects of the invention.

Figure 1:
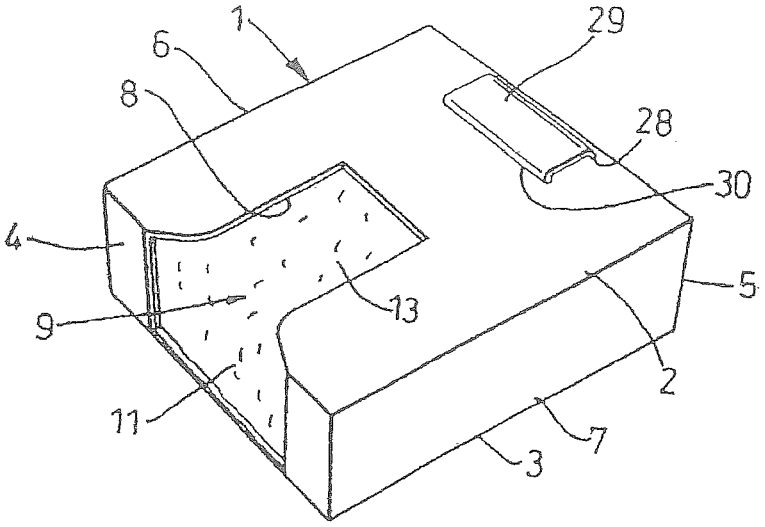
FIG. 1 is a front perspective view of a prior art dispenser according to the present invention.

In FIG. 1, the prior art dispenser comprises a container 1, made of cardboard, which is of a rectangular box-like form having front and back walls 2, 3, opposed first and second end walls 4, 5 and opposed side walls 6, 7. The front wall 2 has an access aperture 8 in it. The access aperture 8 is elongated, generally rectilinear and extends centrally from about half-way along the front wall to the first end wall 4, into which the aperture extends and widens.

Figure 2:
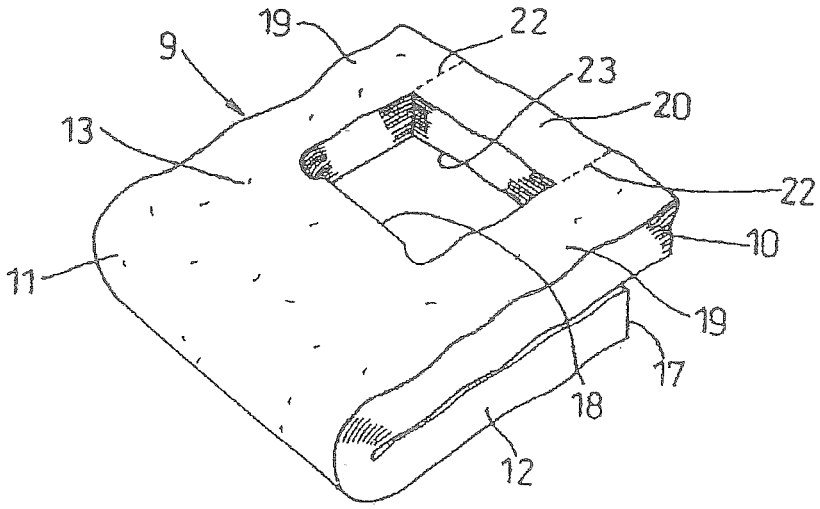
FIG. 2 is a perspective view of a stack of bags included in the dispenser of FIG. 1.
Figure 5:
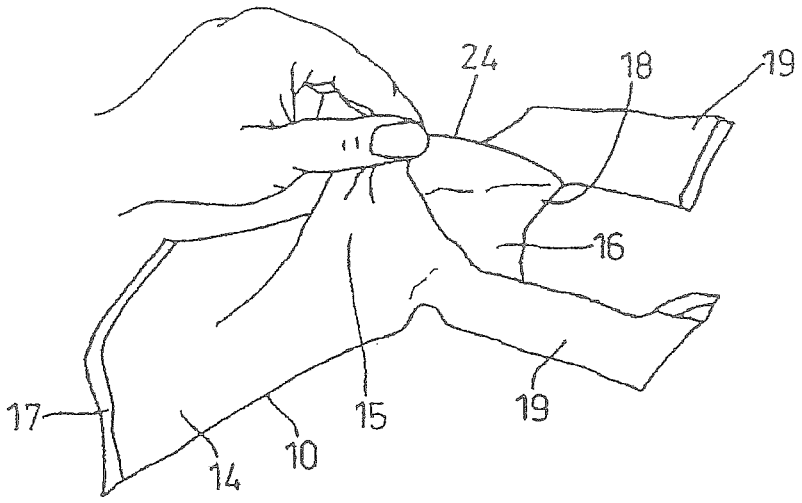
FIG. 5 is a perspective view showing a removed bag.

Located in the container 1 is a stack 9 of bags 10, FIG. 2. The bags 10 are made in known manner from plastics sheet material. They are superimposed flat upon one another and the stack 9 is folded almost in two at a transverse bend 11 so that there is a first portion 12 folded under a second portion 13. Each bag 10, as best seen in FIG. 5, has a flattened rectangular body 14 formed with a front wall 15 and back wall 16 which lie together, a closed base end 17 and an opposite mouth end 18 from opposite ends of which extend a pair of parallel handle portions 19. The handles extend from the front wall 15 to the back wall 16 and are folded in two. The base ends 17 of the bags are at the first portion 12 of the folded stack and the mouth ends 18 and handles 19 are at the second portion 13.

The bodies 14 of adjacent bags in the stack may be connected by small spots of adhesive applied centrally near the mouth ends 18 so that the bags are interconnected in daisy-chain fashion but are readily separated at the adhesive spots.

Formed as part of the stack of bags, from the same material on the bags, is an integral bar block 20, FIG. 2, forming attachment means, which extends between outer ends of the folded handles 19.

The handles are attached to the bar block 20 by lines of weakening 22, defined for example by perforations. Adjacent to the bar block 20, a rectangular slot 23 is cut through the stack which defines mouths 24 at the mouth ends 18 of the bodies 14 of the bags and inside edges of the handles 19. In the folded stack, the base ends of the bags at the first portion 12 are below an intermediate region of the slot 23 and so spaced short of the bar block 20.

Figure 3:
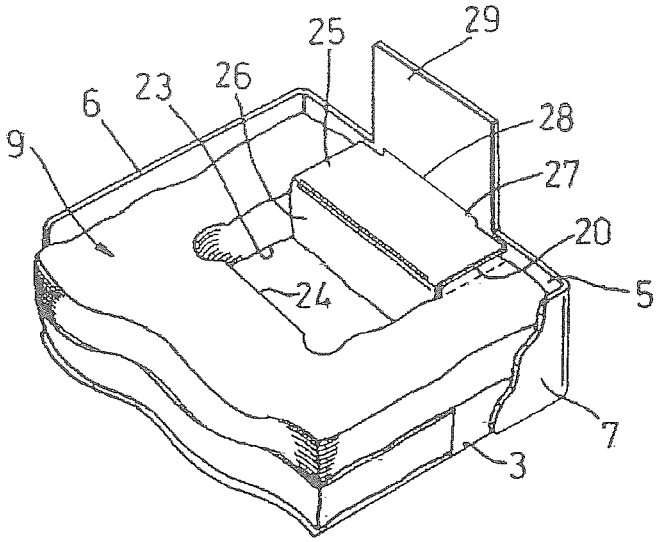
FIG. 3 is a fragmentary perspective view of the prior art dispenser showing how the stack of bags is retained in a container thereof.

The stack 9 is positively retained in position in the container by means of a header 25, FIG. 3, which wraps around the bar block 20. The header 25 is formed from a flap 26 of material cut from, and left joined to, the back wall 3 of the container to a width corresponding to the length of the bar block between the handles 19 of the bags in the stack. The flap 26 is folded into the container, through the slot 23 in the stack and over the bar block, underneath the front wall 2 of the container.

A tongue 27 at the end of the flap 26 is then threaded through slits 28 in the second end wall 5 of the container to hold the header around the bar block so that the bar block is located hard against the second end wall. The flap 26 is further held around the bar block by a security flap 29 which is an extension of the second end wall 5, folds over the end portion of the front wall 2 and is tucked through a further slit 30, in the front wall.

FIG. 1, to lie against the part of the header flap 6 which extends through the slot 23 in the stack.

For ease of loading the stack in the container and applying the header 25 to the bar block, the container may be formed in two shells integrally joined together at the first end wall 4, which fit one over the other when the stack is in place. The shells respectively provide the front and back walls 2, 3 of the container and together provide the end and side walls. The security flap 29 may then serve also to secure the two shells together 20 at the second end wall 5 by being formed as an extension of an end wall part of the shell providing the back wall 3 of the container, inserted through a second slit in the front wall 2 of the other shell adjacent to the second end wall 5, folded over the front wall and tucked into the first mentioned slit 30 in the front wall.

When the stack is in place and the container closed around it, the folded stack extends the full distance inside the container between the end walls and the full width between the side walls. The bar block 20, slot 23 and handles 19 of the bags in the stack are concealed, or substantially so, by the part of the front wall 2 of the container between the access aperture and the second end wall.

The front walls 2 of the bags at the second portion 13 of the folded stack are tensioned by the folding of the stack. An area of the front wall of the bag immediately adjacent to the front wall 2 of the container, from the mouth end 18 to the bend 11, is exposed at the access aperture. The access aperture is dimensioned to restrict access to that bag substantially to three extended fingers and a thumb of one hand of a grown person.

The folded state of the stack in the container provides a degree of resistance to movement of the parts of the bags at the first portion 12 of the stack. That resistance is enhanced by the weight of the second portion on the first portion when the container is used in a portion in which the folded stack is horizontal, or substantially so.

Figure 4:
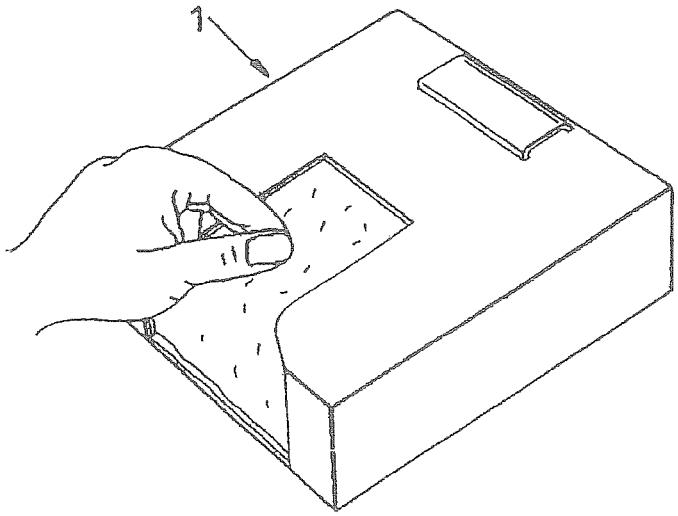
FIG. 4 is a perspective view showing how a bag in the stack may be removed from the container of the prior art dispenser.

In order to remove a bag from the container, a user can pinch the exposed part of the front wall of the bag at the access aperture, as shown in FIG. 4, and pull the part out through the access aperture. As the part is pulled, the front wall of the bag separates from the back wall, sliding freely relative to that wall, which maintains contact with the front wall of the next adjacent bag in the stack with the aid of static electricity built up in the stack from the plastics material and method of manufacture of the bags. The continued pull on the front wall part opens the mouth of the bag with a peeling action which spreads from the region of the mouth nearest to the ends of the mouth and round the handles. The pull also detaches the handles from the bar block 20 at the lines of weakening 22. When the handles are detached, further pulling draws the part of the bag from the second portion of the stack out of the access aperture, and finally the rest of the bag from the first portion is detached from the stack. The fully removed bag is open at its mouth 24 and ready to be filled, as shown in FIG. 5. The whole operation can be done by a user using just one hand, and, by virtue of the size and positioning of the access aperture and the arrangement of the stack in the container, removal of more than one bag at a time is resisted.

A stack of bags 9' is illustrated in FIGS. 6*a* to 6*d*, in accordance with the second and third aspect of the invention. The stack of bags 9' in FIGS. 6*a* to 6*d* is substantially identical to a stack of bags 9 illustrated in FIG. 2 and parts in FIGS. 6*a* to 6*d* corresponding to parts in FIG. 2 carry the same reference numerals. For ease of comprehension, the first bag in the stack of bags 9' shown in FIGS. 6*a* to 6*d* is plain and the second bag in the stack (underneath the first bag) is shown hatched.

Each bag in the stack 9' has a rectangular body 14 with a front wall 15 and back wall 16, together forming closed sides, a closed base end 17 and an opposite, open, mouth end 18. A pair of handles 19 extend parallel with respect to each other from opposite sides of the mouth end 18. The stack 9' is folded almost in two at a transverse bend 11, defining a first portion 12 folded underneath a second portion 14.

A glue spot, forming an adhesion portion 31 is arranged on the back wall 16 of the right-hand handle 19 as shown in FIG. 6*a*. The left-hand handle 19 in FIG. 6*a* has been pulled forward slightly to reveal the hatched second bag in the stack 9'.

FIGS. 6*b* to 6*d* show the process of removal of the first (uppermost) bag in a stack 9'.

In FIG. 6*b*, the user is in the process of pulling the uppermost bag from the stack by pulling on the end of the left-hand handle 19 away from the stack. This applies a force to the stack which is transmitted diagonally across the open mouth 18. The combination of the diagonal pulling, friction of the bag with the rest of the bags in the stack and the static electricity effect described above, contributes better to open the mouth 18 of the bag than the pre-existing bags. As the bag is pulled further from the stack of bags 9', the line of weakening connecting the right-hand handle 19 to the attachment means 20 fails. At this point the glue spot 31 still adheres the back wall 16 of the handle 19 of the first bag in the stack to the front wall 15 of the handle 19 of the second back in the stack 9'. Further pulling of the left-hand handle 19 causes the first bag in the stack 9' to be pulled further from the stack and the right-hand handle of the second bag in the stack begins to come with the right-hand handle of the first bag in the stack (see FIG. 6*c*). Eventually, as the first bag in the stack 9' is pulled completely from the stack, the only thing connecting it to the stack is the glue spot 31. The remainder of the second bag is held in place and the frictional force associated with the installation of the second bag is greater than the force required to cause the glue spot 31 between the first bag and the second bag in the stack 9' to fail.

FIG. 6*d* illustrates the stack 9' after the first bag in the stack has been fully removed. The right-hand handle 19 of the second bag has been pulled forward, the mouth 18 pulled open slightly and the left-hand handle 19 of the second bag in the stack has a glue spot 31 arranged on the back wall thereof to adhere that back wall 16 of the left-hand handle 19 to the front wall 15 of the handle 19 of the third bag in the stack. The process can then be repeated.

FIGS. 7*a* to 7*d* show a similar process to FIGS. 6*a* to 6*d* with the stack of bags 9' located in a container 1'. The container 1' is substantially similar to the container shown in FIGS. 1, 3 and 4 above.

As can be seen in FIG. 7*c*, the container 1' is arranged to retain the stack 9' so that after pulling the first bag from the stack, one of the handles 19 of the second bag in the stack 9' protrudes from the aperture 8 of the container 1' but thereafter the glue spot 31 between the handle on the first bag and the handle on the second bag fails due to the stronger frictional force exerted on the stack of bags than the force required to break the adhesion portion 31. FIG. 7*d* has the stack 9' in similar condition to that shown in FIG. 6*d* with the right-hand handle 19 of the second bag in the stack 9' protruding from the opening 8 ready to be pulled by a user to remove the second bag from the stack.

FIG. 8 shows the container 1' with the front wall 2 removed for clarity and the other walls 4, 5, 6, 7 folded slightly open to aid clarity. It also shows a side elevation of the stack of bags 9'. Parts in FIG. 8 corresponding to parts in the container 1 of FIGS. 1, 3 and 4 carry the same reference numerals.

FIGS. 9*a* to 9*d* show an alternative stack of bags 9". This stack of bags is similar in many respects to that shown in FIGS. 10 to 12 of WO99/30985. In particular, there is a stem of material which extends from the mouth 18 of each bag to the attachment means 20 and which is connected to the mouth of the bag by means of a line of weakening 22*a*. Other than that distinction, the stack of bags in FIGS. 9*a* to 9*d* works in a substantially identical fashion to that described in FIGS. 6*a* to 6*d*.

Likewise, the container 1" shown in FIG. 10 is substantially similar to that shown in FIG. 8 with the exception that the header 25 is split into two parts to accommodate the stem of material extending between the attachment means 20 and the mouth 18.

FIG. 11 simply illustrates that the adhesion portion 31 is arranged on alternating handles of the successive bags in the stack 9".

FIGS. 12*a* to 12*c* show a further alternative stack of bags $\mathbf{9}^{111}$ Parts corresponding to parts in FIGS. 6*a* to 6*d* carry the same reference numerals.

The bags in the stack $\mathbf{9}^{111}$ in FIGS. 12*a* to 12*c* are similar to the bags in FIGS. 6*a* to 6*d* except that they do not include handles 19. Thus, the mouth 24 extends fully across the width of each bag. The bags are joined together at a bar block 20 by respective lines of weakening 22 (perforations). The bar block 20 has a hole 32 therethrough formed generally centrally to allow the stack of bags $\mathbf{9}^{111}$ to be secured in a container, either by a peg or pin or even a cable tie.

As with the bags in FIGS. 6*a* to 6*d*, each bag has a glue spot 31 arranged on the back wall 16 thereof. The glue spot 31 is formed adjacent one side on one bag and the opposite side on the next bag.

The stack $\mathbf{9}^{111}$ is located in a container 1 similar to that shown in FIGS. 1 to 4.

The bags of stack $\mathbf{9}^{111}$ can be removed from the stack, one by one, by pulling the protruding corner from the container.

The lines of weakening are formed such that they fail before the glue spot so that on removal of the top bag, the next bag in the stack is pulled open and the glue spotted corner is pulled out of the aperture of the container, as described above regarding the handle, ready to be pulled by the next user.

The glue spot 31 could be replaced by a regional of localised welding between the back wall of the handle of the uppermost bag in the stack and the front wall of the handle of the lower subsequent bag in the stack. Alternatively, the two surfaces could be locally roughened, for example by applying an electrostatic discharge to the area whereby the locally roughened surfaces, when pressed together, adhere like hook and loop material.

The invention claimed is:

1. A bag dispenser comprising a container and located therein a stack of pre-formed bags and attachment means, the container having an access aperture; the bags of the stack each having a body which is formed with opposed front and back walls forming closed sides, a closed base end and an opposite mouth end; the bags being retained together in the stack by separable attachment at their mouth ends to the attachment means at lines of weakening; each bag having an adhesion portion formed on the front and/or back wall thereof adjacent the mouth end and adjacent one side, the adhesion portions of alternate bags in the stack being formed adjacent respectively opposite sides relative to the next bag in the stack so as to adhere the back wall of one bag to the front wall of the next bag in the region of the adhesion portion, the stack having a transverse bend intermediate the base and mouth ends of the bags whereby at least part of the front walls of the bags are presented towards the access aperture to enable the bag nearest the aperture to be drawn out through the aperture by manual pulling, whereby the friction between the container and the stack of bags and the relative strengths of the lines of weakening and the adhesion portions, upon removal of the uppermost bag in the stack, cause the uppermost bag to be pulled from the container and cause the next bag in the stack partially to be pulled from the container, the adhesion portion between the uppermost bag and the next bag being arranged to fail after part of the next bag has been pulled from the container.

2. A pre-formed bags dispenser according to claim 1 wherein the container is a bag which has the access aperture in a frontal part.

3. A stack of pre-formed bags wherein it is adapted to be used in a bag dispenser as claimed in claim 1.

4. The bag dispenser according to claim 1 wherein the container is formed from a single integral sheet of material cut and having fold lines defined therein for the container to be folded into its finished shape.

5. The bag dispenser according to claim 1 in which the bags of the stack are formed with handles at their mouth ends.

6. The bag dispenser according to claim 5, in which the adhesion portion is formed on the front and/or back wall of alternating handles.

7. The bag dispenser according to claim 5, wherein the mouth ends of the bags are separably attached to the attachment means at the handles.

8. The bag dispenser according to claim 7 wherein the mouth ends of the bags are also separably attached to the attachment means at the mouths of the bags.

9. The bag dispenser according to claim 1 wherein the attachment means is formed integrally with the stack, of the material of the bags of the stack.

10. The bag dispenser according to claim 9 wherein the attachment means comprises projections on the mouth ends of the bags.

11. The bag dispenser according to claim 9 wherein the attachment means comprises a combination of a bar block and projections at the mouth ends of the bags.

12. The bag dispenser according to claim 1 wherein the attachment means comprises a barblock of the material of the bags separably attached to the mouth ends of the bags.

13. The bag dispenser according to claim 12, and where the bags of the stack are formed with handles at their mouth ends, wherein the bar block extends between and is separably attached to the handles.

14. The bag dispenser according to claim 13 wherein the bar block further extends between and is separably attached to the mouths of the bags.

15. The bag dispenser according to claim 14 wherein the bar block is a T-bar block, the cross part of the T extending between and being joined to the mouths of the bags intermediate the handles.

16. The bag dispenser according to claim 15 wherein the base end of each bag of the folded stack has separably joined thereto a tab which is located with respect to a stem part of the T-bar block and in which the bags of the stack are formed with handles at their mouth ends.

17. The bag dispenser according to claim 15 wherein the tabs are attached to the stem part of the T-bar block.

18. The bag dispenser according to claim 17 wherein the tabs are attached to the stem part by means of a pin passed through holes in the tabs.

19. The bag dispenser according to claim 16 wherein the tabs are separably joined to the base ends by lines of weakening.

20. The bag dispenser according to claim 1 wherein the access aperture is positioned and dimensioned for the nearest bag of the stack, at a second portion of the stack, to be exposed from adjacent to the mouth of the bag to the bend.

21. The bag dispenser according to claim 20 wherein the access aperture extends around the bend of the stack.

22. The bag dispenser according to claim 20 wherein the access aperture is enlarged at or towards the bend.

23. The bag dispenser according to claim 6 wherein the access aperture has an edge positioned to deter a person from putting his or her hand into the container between the handles of the bags of the stack.

24. The bag dispenser according to claim 6 wherein the access aperture has an edge at which a restraint is provided positioned to deter a person from putting his or her hand into the container between the handles of the bags of the stack.

25. The bag dispenser according to claim 1 wherein the container is of a generally box or tray-like form having a front part in which is the access 10 aperture.

26. The bag dispenser according to claim 25 wherein the container is of box form and is substantially closed except for the access aperture.

27. The bag dispenser according to claim 26 wherein the container has opposite ends and sides and opposed front and back walls in the front one of which is the access aperture, and the attachment means is held captive in the container at or adjacent to one of the opposite ends.

28. The bag dispenser according to claim 1 wherein the attachment means is held captive in the container by retention means engaged therewith and anchored to the container.

29. The bag dispenser according to claim 28 wherein the container has a header part which is folded around at least a part of the bar block and secured in the folded state to hold the bar block captive in the container, and wherein the attachment means comprises a bar block of the material of the bags separably attached to the mouth ends of the bags; and the container is formed from a single integral sheet of material cut and having fold lines defined therein for the container to be folded into its finished shape.

30. A stack of pre-formed bags, each bag comprising a body having a front wall and a back wall defining opposite closed sides, a closed base end and an open mouth end, each bag having an adhesion portion formed on the front and/or back wall thereof adjacent the mouth end and adjacent one side, the adhesion portions of alternate bags in the stack being formed adjacent respectively opposite sides relative to the next bag in the stack so as to adhere the back wall of one bag to the front wall of the next bag in the region of the adhesion portion.

* * * * *